US007611299B2

(12) United States Patent
Ochiai et al.

(10) Patent No.: US 7,611,299 B2
(45) Date of Patent: Nov. 3, 2009

(54) THERMAL PRINTER

(75) Inventors: Teruyuki Ochiai, Shuzuoka (JP); Hiroyasu Ishii, Shizuoka (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 623 days.

(21) Appl. No.: 11/430,570

(22) Filed: May 9, 2006

(65) Prior Publication Data

US 2006/0257189 A1 Nov. 16, 2006

(30) Foreign Application Priority Data

May 12, 2005 (JP) ..... 2005-139959

(51) Int. Cl.
*B41J 2/315* (2006.01)

(52) U.S. Cl. ..... 400/120.17; 400/56; 347/198

(58) Field of Classification Search ..... 400/120.16, 400/120.17, 56, 57, 59; 347/197, 198, 220
See application file for complete search history.

(56) References Cited

U.S. PATENT DOCUMENTS 4,494,887 A * 1/1985 Wincent ..... 400/568
4,797,017 A * 1/1989 Okouchi ..... 400/59
4,883,375 A * 11/1989 Karube et al. ..... 400/55
4,906,115 A 3/1990 Bischof
5,005,026 A 4/1991 Sakai
5,516,219 A 5/1996 Leonard et al.
5,588,757 A * 12/1996 Unosawa et al. ..... 400/279
5,846,003 A 12/1998 Mori et al.
5,918,990 A 7/1999 Abumehdi
7,014,376 B2 * 3/2006 Maruyama et al. ..... 400/120.01

FOREIGN PATENT DOCUMENTS

EP 0 308 566 A1 3/1989
EP 0 392 213 A2 10/1990
EP 0 806 297 A2 11/1997
EP 0 856 409 A2 8/1998
JP 7-125379 A 5/1995
JP 2004-255730 A 9/2004

* cited by examiner

*Primary Examiner*—Ren Yan
(74) *Attorney, Agent, or Firm*—Frishauf, Holtz, Goodman & Chick, P.C.

(57) ABSTRACT

A thermal print head has a row of heating elements arranged in a printing position in which the heating elements row abuts against a platen via a paper guide path. The thermal print head is held so as to be displaceable in an adjusting direction substantially orthogonal to a rectilinear direction between the heating elements row and the platen. Positioning pins projecting from both sides of the thermal print head are fitted in positioning grooves so as to be movable in the adjusting direction The position of the positioning pins in the positioning grooves is displaced in the adjusting direction by displacement of movable pieces each adapted to project selectively from opposite sides of each of the positioning grooves, thereby making the position of the heating elements row adjustable in the adjusting direction.

9 Claims, 9 Drawing Sheets

THERMAL PRINTER

CROSS REFERENCE TO RELATED APPLICATION

The present application is based on Japanese Priority Document P2005-139959 filed on May 12, 2005, the content of which is incorporated herein by reference

BACKGROUND OF THE INVENTION

1. Field of the Invention

The present invention relates to a thermal printer and particularly to a technique which makes a positional relation between a platen and a thermal print head adjustable.

2. Discussion of the Background

In a thermal printer, for attaining a high grade printing, the position of abutment between a row of heating elements provided in a thermal print head and a platen is important. That is, it is desirable that the row of heating elements is positioned on a radial line centered on the axis of the platen.

On the other hand, the platen and the thermal print head are used with paper interposed in between. The interposition of paper causes a slight shift of a positional relation between the platen and the row of heating elements. Therefore, the positional relation between the platen and the row of heating elements must be adjusted while assuming a paper-interposed state.

FIGS. 9(A) and 9(B) are schematic diagrams each showing a positional relation between a platen and a row of heating elements provided in a thermal print head. FIG. 9(A) shows a positional relation in case of using thin paper, while FIG. 9(B) shows a positional relation in case of using thick paper. As the thickness of paper l various thicknesses are employable. The position between a platen 2 and a thermal elements row 4 provided in a thermal print head 3 differs between the use of thin paper 1 and the use of thick paper 1. As an example, if a positional relation between the platen. 2 and the -thermal print head 3 is set so that the heating elements row 4 is positioned on a radial line R of the platen 2 while assuming the case where thin paper 1 is interposed between the platen and thermal print head, the position of the heating elements row 4 is displaced from the radial line R in case of using thick paper 1. This is because the thermal print head 3 is displaced in a direction away from the platen 2 by an amount corresponding to the thickness of paper 1. In this case, if the thickness of paper 1 increases, the stiffness of the paper increases as well and the paper 1 itself moves slightly away from the platen 2. Such a phenomenon causes the positional deviation of the heating elements row 4 from the radial line R.

Japanese Patent Laid-Open Publication No. Hei 07 (1995)-125379 describes a technique which offers a measure against dislocation between a platen and a row of heating elements according to paper thickness. According to this technique, a thermal print head is fixed to a bracket with screws so as to permit a slight distance displacement between the bracket and the thermal print head. The direction of the displacement corresponds to a paper conveying direction. Further, plural sets of a combination of a through hole formed in the bracket with an aperture formed in the thermal print head is provided corresponding to the above slight distance displacement and a positioning pin is passed through the through hole and the aperture in a desired set, thereby making a positional adjustment possible between the bracket and the thermal print head. See paragraphs 0006, 0012 and FIG. 1 in Japanese Patent Laid-Open Publication No. Hei 07 (1995)-125379.

According to the technique disclosed in the above laid-open publication, however, when adjusting the position of the thermal print head, it is necessary to perform such operations as loosening the screws used to fix the thermal print head to the brackets, thereafter removing the positioning pin, aligning the through hole in the bracket and the aperture in the thermal print head in the desired set with each other, inserting the positioning pin into the through hole and the aperture, and again tightening the screws. Thus, the operations are complicated. Moreover, the construction involving insertion of the positioning pin into the through hole and the aperture requires a space for -the positioning pin and a work space over an upper surface of the thermal print head. Consequently, the layout of the entire printer is greatly limited.

SUMMARY OF THE INVENTION

Accordingly, it is an object of the present invention to improve the workability when finely adjusting a positional relation between a platen and a row of heating elements in a thermal print head according to the thickness of paper used.

It is another object of the present invention to prevent placing a limitation in layout on the whole of a printer when constructing the printer so as to permit a fine adjustment of a positional relation between a platen and a row of heating elements in a thermal print head according to the thickness of paper used.

The above objects of the present invention are achieved by a novel thermal printer of the present invention.

According to the present invention, a thermal printer is provided which includes: (i) a rotatable platen, (ii) a thermal print head including a row of a plurality of heating elements, which is arranged rectilinearly at a printing position where the heating elements are abutted against the platen, (iii) a head holding mechanism for holding the thermal print head to be displaceable in an adjusting direction which is orthogonal to a rectilinear direction between the row of heating elements and a rotational center of the platen, (iv) positioning pins projecting from both sides of the thermal print head, (v) positioning grooves in which the positioning pins are adapted to be fitted so as to be displaceable in the adjusting direction, and (iv) a displacing mechanism including a movable piece, which is movable across an associated one of the positioning grooves such that the movable piece is movable to selectively project from opposite sides of the associated positioning groove, wherein the displacing mechanism positions the positioning pin in the corresponding positioning groove in one of two different positions in the adjusting direction in accordance-with one of the sides of the associated position groove from which the movable piece projects, so as to position the thermal print head in one of two different printing positions in the adjusting direction.

DETAILED DESCRIPTION OF THE PREFERRED EMBODIMENT

An embodiment of the present invention will be described hereinafter with reference to FIGS. 1 to 8(B). This embodiment is an application to a thermal label printer.

Figure 1:
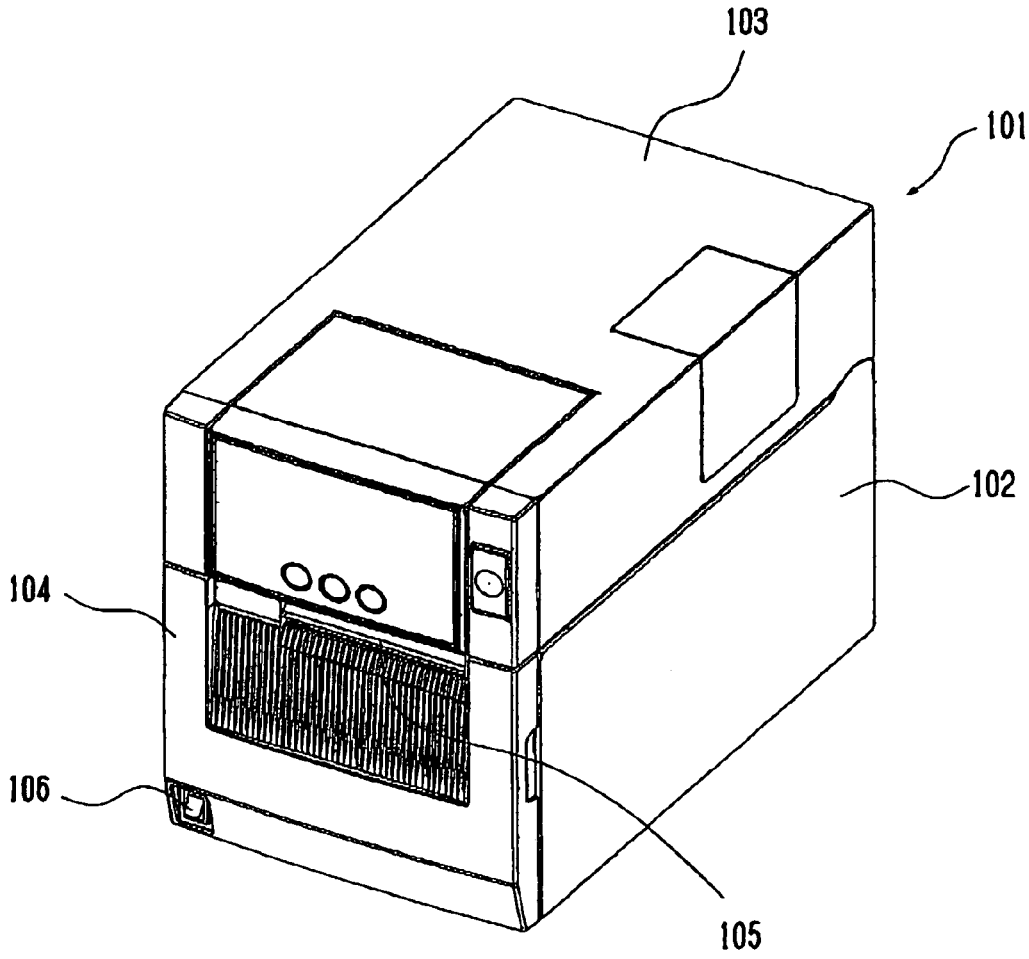
FIG. 1 is a perspective view showing a thermal printer according to an embodiment of the present invention.

FIG. 1 is a perspective view of the thermal label printer. A housing 101 is provided, which is divided into upper and lower sides The housing 101 positioned on the lower side and components accommodated therein constitute the lower unit 102, while the housing positioned on the upper side and components accommodated therein constitute the upper unit 103. The upper unit 103 can be opened and closed with respect to the lower unit 102 around a fulcrum (not shown) located at a rear position.

A front panel 104 is provided on a front side of the housing 101. The front panel 104 is divided into upper and lower portions, thereby the lower unit 102 includes one portion of the front panel 104 and the upper unit 103 includes another portion of the front panel 104. In the front panel 104, an issuance port 105 is formed in a boundary portion between the lower unit 102 and the upper unit 103. Therefore, a lower edge portion of the issuance port 105 is formed by the front panel 104 located on the lower side and attached to the lower unit 102, while an upper edge portion of the issuance port 105 is formed by the front panel 104 located on the upper side and attached to the upper unit 103. A power switch 106 is mounted in a left lower position of the front panel 104 of the lower unit 102.

Figure 2:
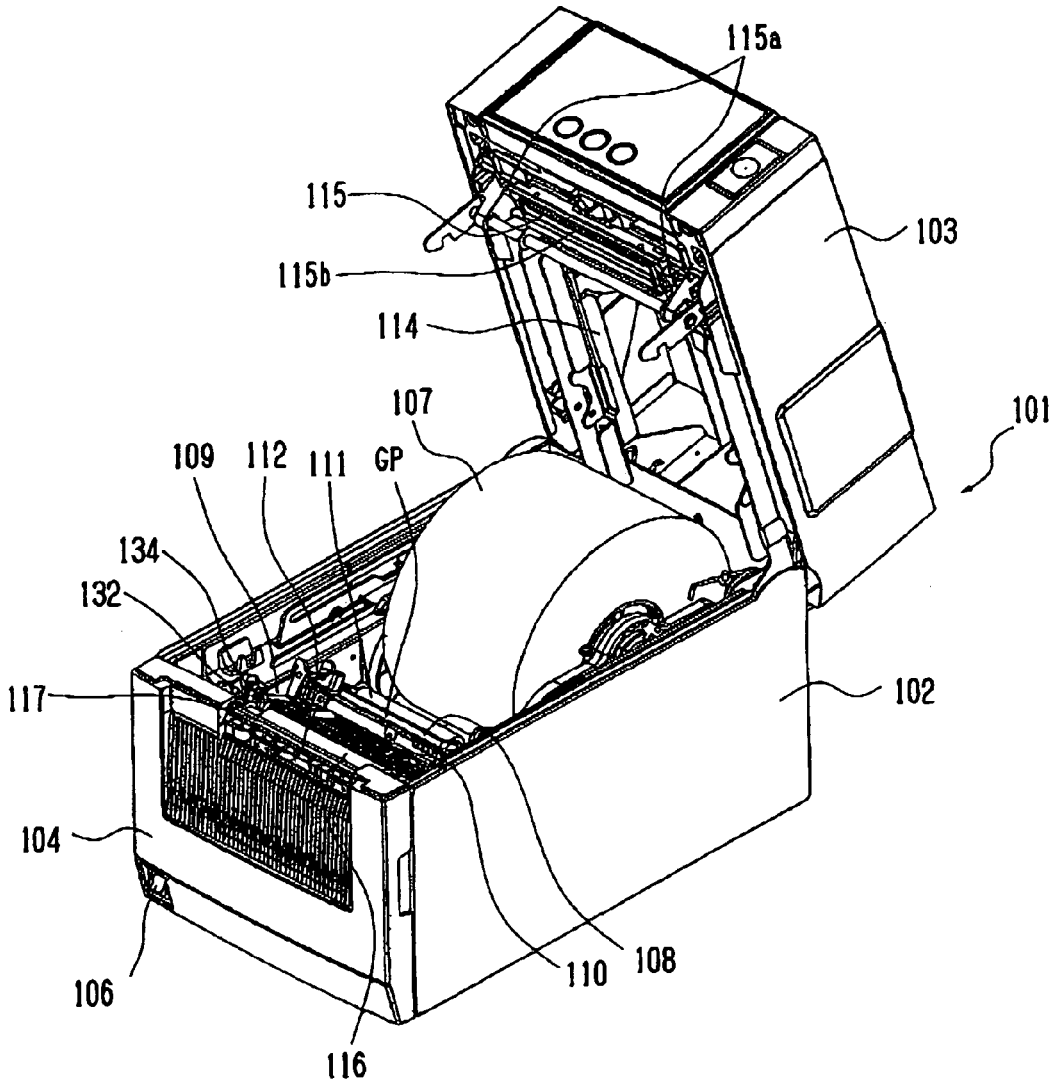
FIG. 2 is a perspective view of the thermal printer with an upper unit opened.

FIG. 2 is a perspective view showing an opened state of the upper unit 103. Rolled paper 107 is accommodated and held within the lower unit 102. Though not shown in detail, the paper 107 is label paper comprising long base paper and thermosensitive labels affixed thereto at certain intervals. A feed roller unit 108, a lower base unit 109 and a sensor unit 110 are disposed within the space extending from the receptacle space of the paper 107 up to the issuance port 105. A feed roller 111 is mounted rotatably to the feed roller unit 108. A platen unit 112 is mounted removably to the lower base unit 109. Further, three optical sensors 113 (see FIG. 3) are attached to the sensor unit 110.

An upper base unit 114 is provided in the upper unit 103. A thermal print head 115 is attached to the upper base unit 114.

A paper guide path GP for guiding the paper 107 is formed between the lower base unit 109 and the upper base unit 114 so as to be positioned within the space extending from the receptacle space of the paper 107 up to the issuance port 105.

Figure 3:
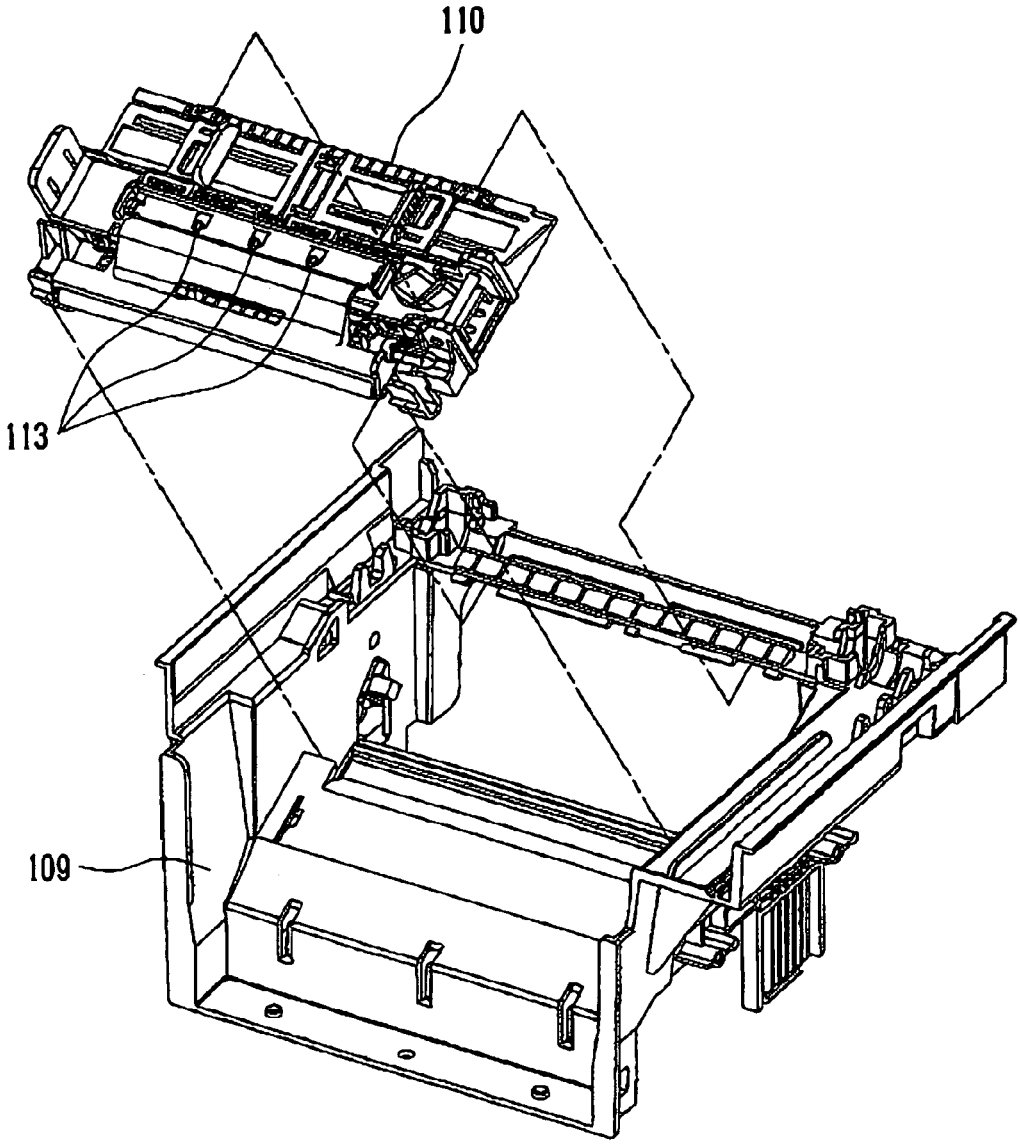
FIG. 3 is an exploded perspective view of a lower base unit and a sensor unit both accommodated within a lower unit.

FIG. 3 is an exploded perspective view of the lower base unit 109 and the sensor unit 110, both accommodated within the lower unit 102. As shown in the same figure, the sensor unit 110 is mounted to the lower base unit 109. The lower base unit 109 is received and fixed into the lower unit 102.

Figure 4:
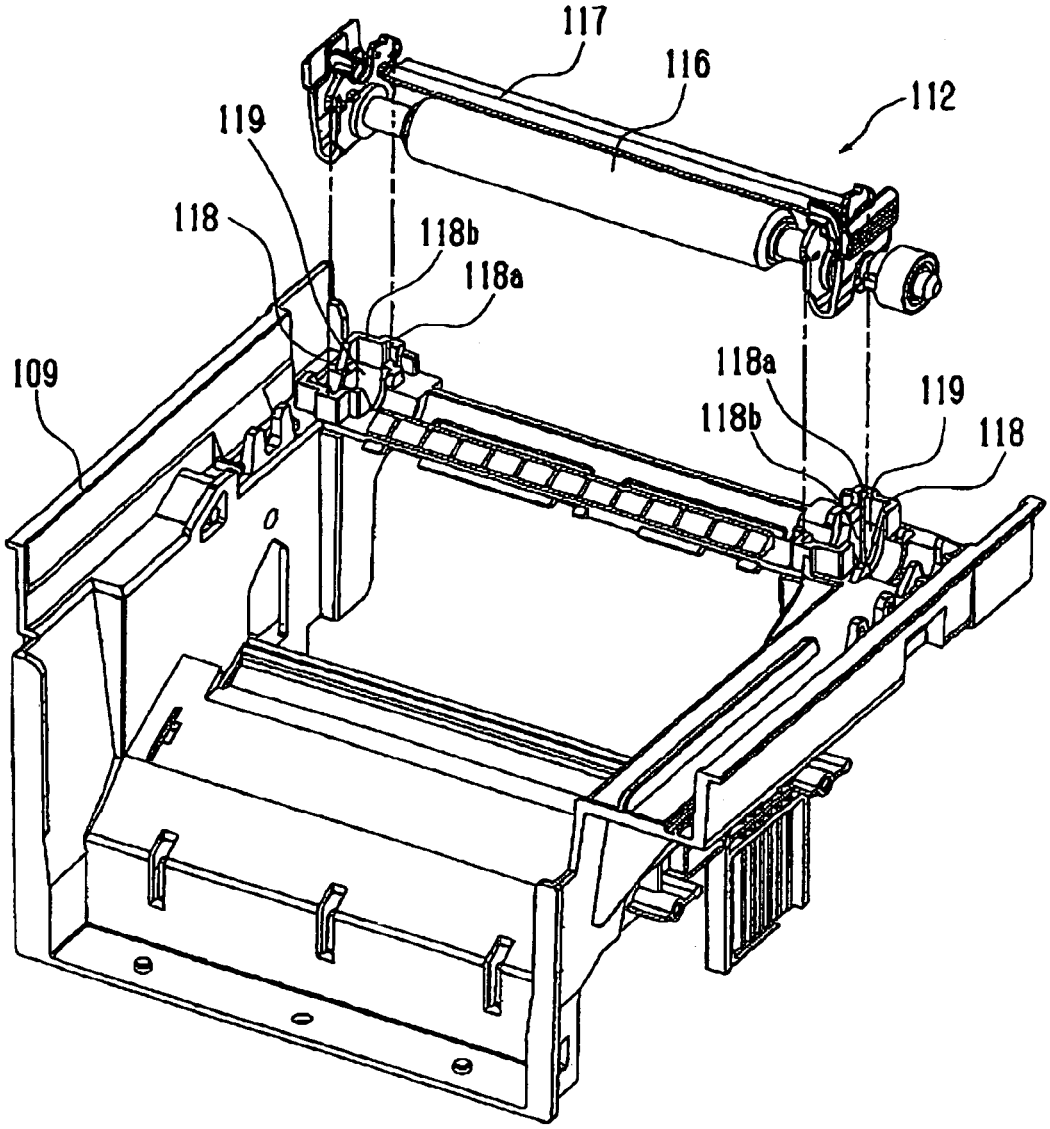
FIG. 4 is an exploded perspective view of the lower base unit and a platen unit both accommodated within the lower unit.

FIG. 4 is an exploded perspective view showing the state where the platen unit 112 is mounted to and dismounted from the lower base unit 109 shown in FIG. 3. The platen unit 112 supports a platen 116 rotatably and fixes a label peeling plate 117. As to the details of the platen unit 112, a description will be given later with reference to FIG. 5. A pair of holder receptacles 118 for holding the platen unit 112 detachably are formed at both side positions of a front end of the lower base unit 109. The holder receptacles 118 have respective receiving holes 119 for insertion therein of part of the platen unit 112 and establish a position of the platen unit 112 when the platen unit 112 is inserted partially into the receiving holes 119.

Figure 5:
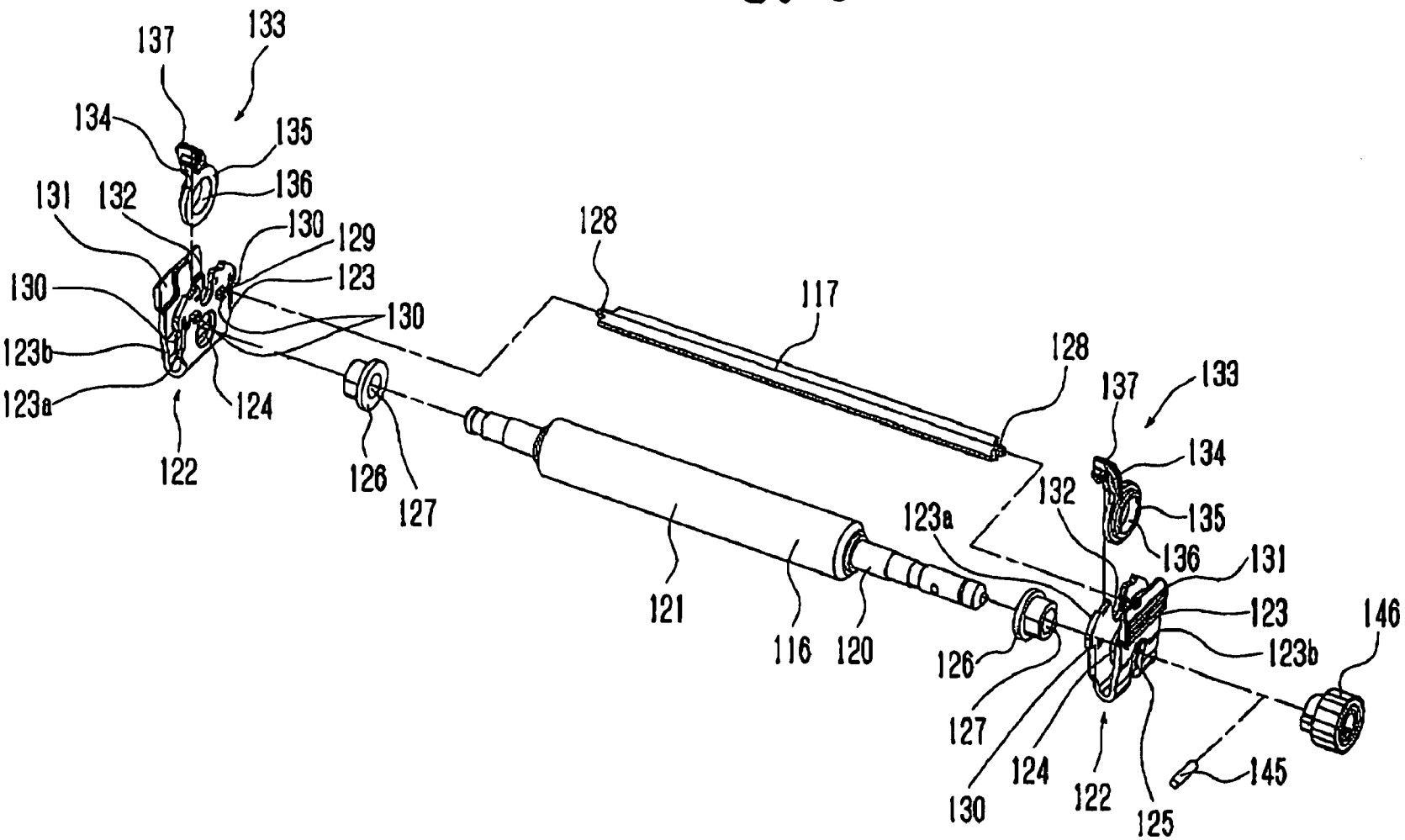
FIG. 5 is an exploded perspective view of the platen unit.

FIG. 5 is an exploded perspective view of the platen unit 112. The platen 116 is made up of a platen shaft 120 and a roller portion 121 formed at a middle portion of the outer periphery of the platen shaft 120, the roller portion 121 being formed using such a material as rubber. The platen unit 112 has a pair of shaft holders 122 for holding the platen shaft 120 rotatably. The shaft holders 122 are each provided with a holder body 123 which is a resin molded product bent in U shape. The holder body 123 is made up of an inner piece 123*a* which constitutes one side of the U shape and an outer piece 123*b* which constitutes another side of the U shape. The inner piece 123*a* and the outer piece 123*b* are formed so as to be elastically deformable in their approaching and separating directions. The inner piece 123*a* has a through hole 124 for passing the platen shaft 120 therethrough. The outer piece 123*b* has a through slot 125 for passing the platen shaft 120 therethrough. The through hole 124 formed in the inner piece 123*a* is a deformed hole and not a truly round hole. A bearing 126 of a shape conforming to such a deformed shape is fitted in the through hole 124. Thus, the fitting between the through hole 124 and the bearing 126 is a fitting in an out-of-roundness shape, so that the bearing 126 is swivel-stopped relative to the through hole 124. A holding hole 127 is centrally formed in the bearing 126 and the platen shaft 120 is rotatably fitted in the holding hole 127, whereby the plate shaft 120 is put in a journaled state.

The holder body 123 also holds the label peeling plate 117. More specifically, the label peeling plate 117 is provided at both ends thereof with projecting portions 128. The projecting portions 128 are fitted in peeling plate holding holes 129 formed in the holder bodies 123. In this way the label peeling plate 117 is held by a pair of holder bodies 123.

In each holder body 123, the inner piece 123*a* is wider than the outer piece 123*b*. Each of the holder receptacles 118 formed in the lower base unit 109 has an inner piece receptacle 118*a* for receiving the inner piece 123*a* therein and an outer piece receptacle 118*b* for receiving the outer piece 123*b* therein (see FIG. 4) in conformity with the shape of each holder body 123. The inner piece receptacle 118*a* is formed in a groove shape so that the inner piece 123*a* of the holder body 123 can be fitted and held therein without play. On the other hand, the outer piece receptacle 118*b* holds the outer piece 123*b* of the holder body 123 in a deflected state and the outer piece 123*b* is displaceable in approaching and separating directions of the inner piece. That is, an axial length of the platen 116 in the holder receptacle 118 is set to a length which permits the outer piece 123*b* of the holder body 123 in a fitted state with the holder receptacle 118 to be deformed elastically in a direction to approach the inner piece 123*a*. Therefore, with the holder body 123 held by the holder receptacle 118, the outer piece 123*b* of the holder body 123 is deformed elastically and, with its restoring force, the fitted state of the holder body 123 with respect to the holder receptacle 118 is maintained.

In each holder body 123 of such a structure there are provided a positioning structure for when the holder body 123 is held by the holder receptacle 118 and a work assisting structure for assisting removal of the holder body 123 from the holder receptacle 118. As the positioning structure, the inner piece 123*a* is formed with positioning portions 130 which come into abutment against the holder receptacle 118 to establish a position of the holder receptacle 118 as the holder body 123 is fitted in the holder receptacle. As the work assisting structure, a first grip 131 is formed at an end portion of the outer piece 123*b*. The first grips 131 on both sides of the platen are to be grasped for displacing the outer pieces 123*b* of the holder-bodies 123 toward the inner pieces 123*a* and for removing, in this state, the shaft holders 122 from the holder receptacles 118, or are to be grasped in performing reverse operations. Thereby, the first grips 131 improve the workability in these operations.

As set forth above, the platen unit 112 plays the role of holding the platen 116 and the label peeling plate 117 and facilitating the work of mounting and dismounting the platen 116 and the label peeling plate 117 with respect to the lower unit 102. Another important role of the platen unit 112 is to position the thermal print head in the upper unit 103 movably. The following description is now provided about a structure for this positioning operation.

Figure 6A:
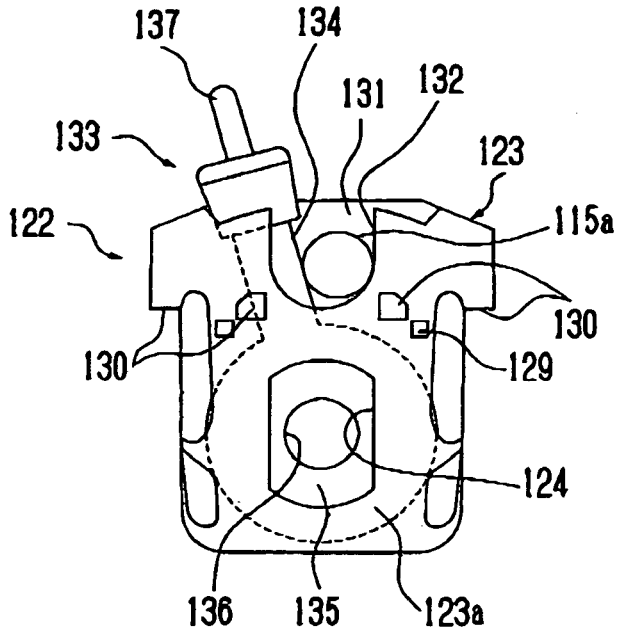
FIG. 6 is a side view showing a shaft holder and a movable piece both constituting a part of the platen unit.
Figure 6B:
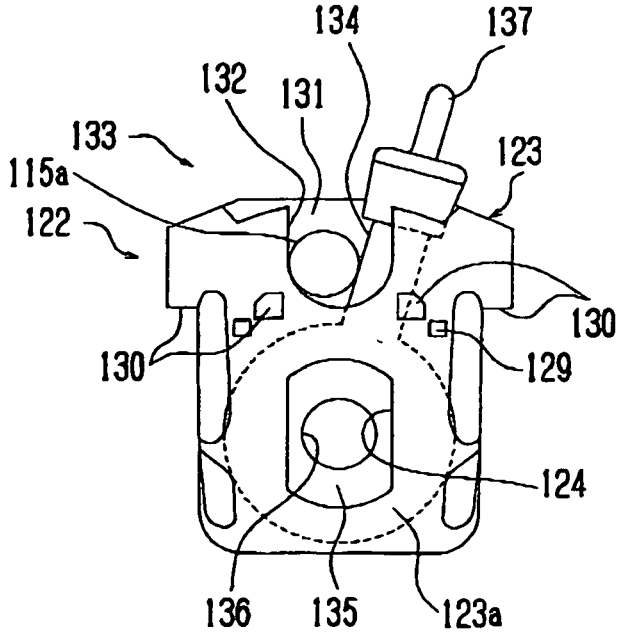

FIGS. 6(A) and 6(B) are side views showing the shaft holder which constitutes a part of the platen unit 112, as well as a movable piece. A positioning groove 132 is formed in the inner piece 123*a* of each holder body 123 at a position above the through hole 124. The positioning grooves 132 in both holder bodies 123 permit a pair of positioning pins 115*a* to be fitted therein to establish a position of the thermal print head 115. The pair of positioning pins 115*a* project from both sides of the thermal print head 115 provided in the upper unit 103. The diameter of each positioning pin 115*a* is a little smaller than the diameter of the positioning groove 132. As a result, each positioning pin 115*a* is slightly displaceable in the interior of the positioning groove 132. In this case, the displacing direction is a direction substantially orthogonal to a rectilinear direction joining a heating elements row 115*b* in the thermal print head 115 and the rotational center of the platen 116 when the heating elements row 115*b* is in abutment against the platen 116. For convenience sake, this direction is designated as the "adjusting direction" and the position where the heating elements row 115*b* in the thermal print head 115 is put in abutment against the platen 116 is designated as the "printing position."

Each shaft holder 122 has a displacing mechanism 133 for displacing the position of the positioning pin 115*a* in the interior of the positioning groove 132 to make the position of the thermal print head 115 adjustable when the thermal print head 115 is in a positioned state with the positioning pins 115*a* in both holder bodies 123 fitted in the positioning grooves 132. According to the structure for effecting this displacement, each shaft holder 122 has a movable piece 134 positioned between the inner piece 123*a* and the outer piece 123*b* of the holder body 123. As shown in FIGS. 5 and 6, the movable piece 134 is disposed in alignment with the through hole 124 formed in the inner piece 123*a* of the holder body 123 and projects radially from a ring-like base portion 135 which permits the platen shaft 120 to pass therethrough when the platen shaft passes through the through hole 124. The base portion 135 has a base hole 136 of true roundness for fitting therein of the platen shaft 120 and is therefore rotatable about the platen shaft. A second grip 137 is formed at a front end of the movable piece 134. Therefore, by grasping the second grip 137 and making the base portion 135 rotate about the platen shaft 120, it is possible to change the direction of projection of the movable piece 134 from the positioning groove 132. That is, by making the base portion 135 rotate about the platen shaft 120, it is possible to select which of the opposed sides of the positioning groove 132 from which the movable piece 134 is to project. FIG. 6(A) shows a state in which the movable piece 134 projects from the left side of the positioning groove 132. This state is attained by grasping the second grip 137 and rotating the base portion 135 in the counterclockwise direction when seen in the direction shown in the FIG. 6(A). FIG. 6(B) shows a state in which the movable piece 134 projects from the right side of the positioning groove 132. This state is attained by grasping the second grip 137 and rotating the base portion 135 in the clockwise direction when seen in the direction shown in FIG. 6(B). As noted previously, since the positioning pin 115*a* is slightly displaceable in the interior of the positioning groove 132, the positioning pin 115*a* can be located at two different positions in the adjusting direction in accordance with the direction of projection of the movable piece 134 with respect to the positioning groove 132. As a result, the thermal print head 115 can also be located at two different printing positions in the adjusting direction.

Figure 7:
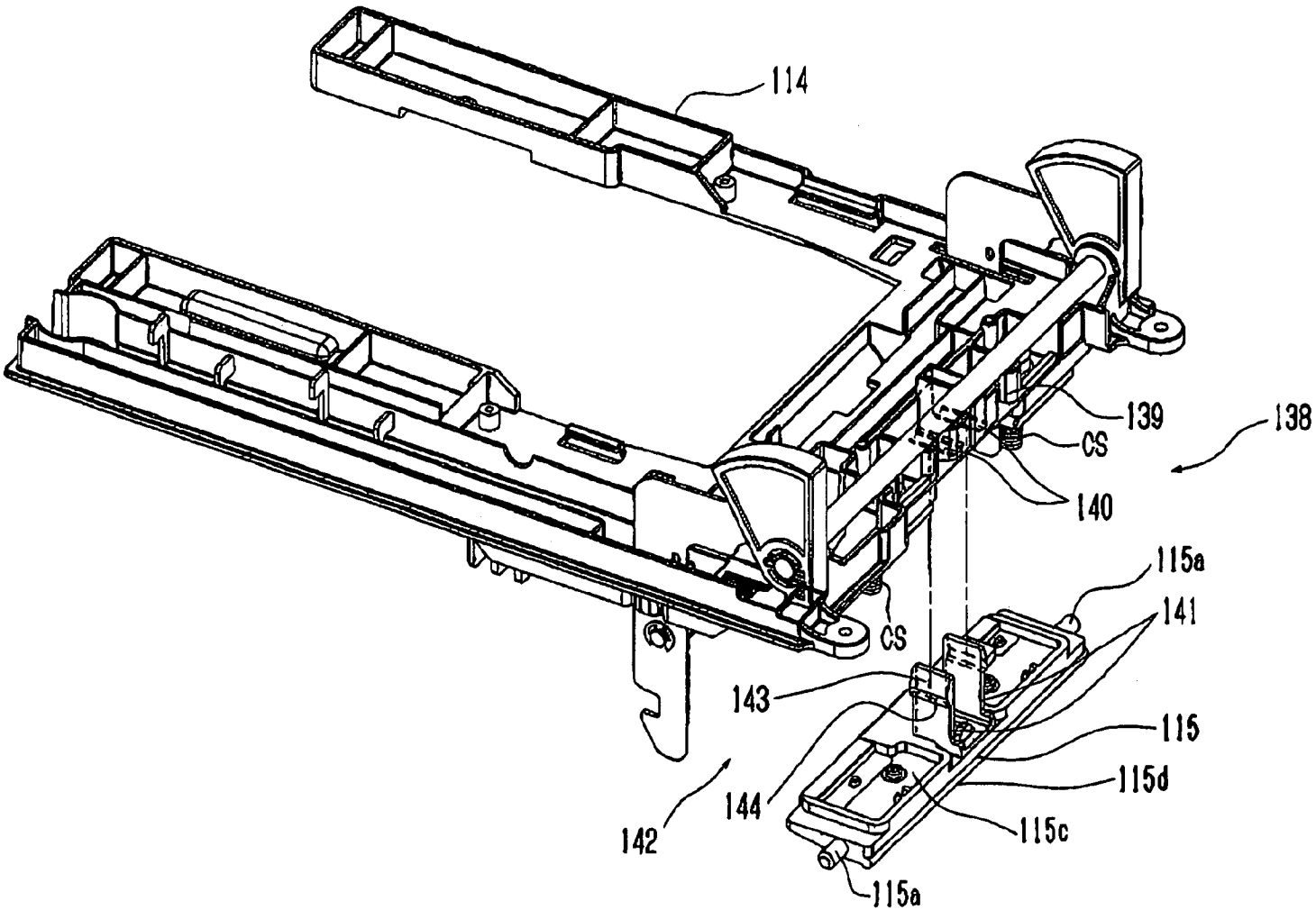
FIG. 7 is an exploded perspective view showing in the state where a thermal print head is mounted to and dismounted from an upper base unit accommodated within the -upper unit.

FIG. 7 is an exploded perspective view showing in the states where the thermal print head 115 is mounted and dismounted with respect to the upper base unit 114 accommodated within the upper unit 103. The thermal print head 115 is formed by attaching a head body 115*c* to a head cover 115*d*, which is a resin molded product. The head body 115*c* includes a plurality of heating elements (not shown) arranged rectilinearly to form the heating elements row 115*b*. As an example, the positioning pin 115*a* is formed of metal and is buried in the head cover 115*d* at the time of molding of the head cover.

The thermal print head 115 constructed as above is attached to the upper base unit 114 detachably and displaceably in approaching and separating directions with respect to the upper base unit 114 and in the adjusting direction, and the upper base unit 114 is accommodated and held within the upper unit 103 by means of a head holding mechanism 138. More specifically, the portion of the upper base unit 114 for holding the thermal print head 115 is formed as a holder 139 and a pair of long holes 140 which are long in the adjusting direction are formed in parallel to each other in the holder 139. The thermal print head 115 has a pair of to-be-held portions 141 which extend upward from the head cover 115*d* and which are inserted from below into the long holes 140 with play in the extending direction and the adjusting direction. The to-be-held portions 141 are attached to the head cover 115*d* in a positionally fixed state and are prevented from dislodgment by an anti-dislodgment mechanism 142 when they are inserted into the long holes 140. Since the to-be-held portions 141 are thus inserted into the long holes 140 in a dislodgment-prevented state and with play in only their extending direction and the adjusting direction, the thermal print head 115 is mounted so as to be displaceable in approaching and separating directions with respect to the holder 139 and in the adjusting direction.

The free movement of the thermal print head 115 approaching and separating from the holder 139 is restricted by a coiled spring CS as an elastic member attached to the holder 139. More specifically, the coiled spring CS is attached to the holder 139 so as to be interposed between the holder 139 and the thermal print head 115. The coiled spring CS urges the thermal print head 115 in a direction away from the holder 139.

Figure 8A:
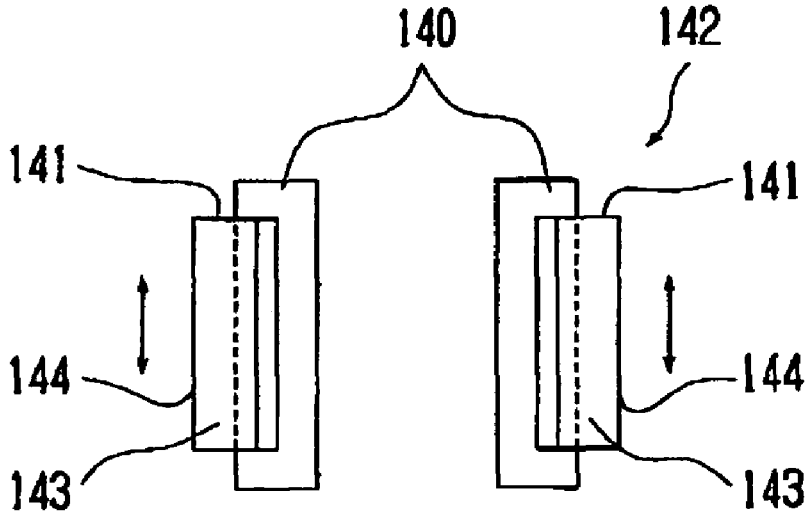
FIG. 8(A) is a plan view showing an anti-dislodgment mechanism in the thermal print head.
Figure 8B:
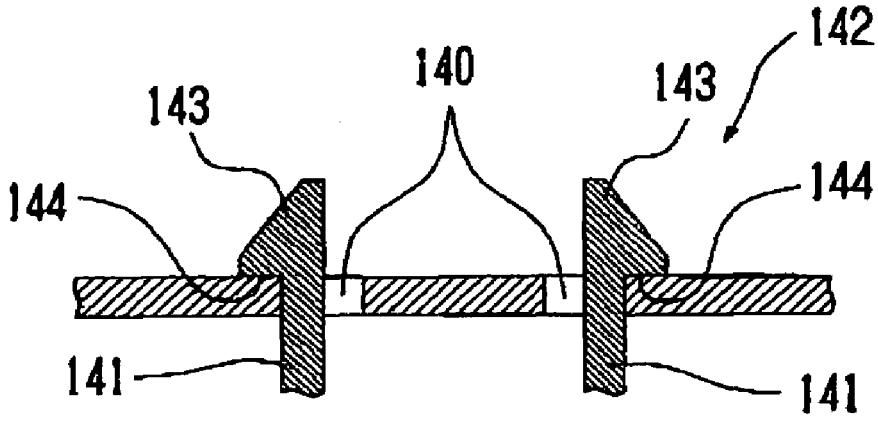
FIG. 8(B) is a front view of the anti-dislodgment mechanism.

FIG. 8(A) is a plan view showing the anti-dislodgment mechanism 142 in the thermal print head 115 and FIG. 8(B) is a front view thereof. The anti-dislodgment mechanism 142 is made up of the to-be-held portions 141, inclined portions 143 formed at front ends of the to-be-held portions 141, and pawl portions 144. The pair of opposed to-be-held portions 141 have an elastic force in the transverse direction of the long holes 140. The to-be-held portions 141 are formed at a position where they come into abutment against edge portions of the long holes 140 when the to-be-held portions 141 are inserted into the long holes 140, and by abutment of the inclined portions 143 against edge portions of the long holes 140 upon insertion of the to-be-held portions 141 into the long holes 140, the to-be-held portions 141 are deflected. The pawl portions 144 are formed contiguously to the inclined portions 143. When the deflected to-be-held portions 141 revert to their initial shape as the inclined portions 143 pass through the long holes 140, the pawl portions 144 are caught on peripheral edges of the long holes 140 to prevent dislodgment of the to-be-held portions 141.

The width in the transverse direction of each long hole 140 is wider than the width in the same direction of each to-be-held portion 141, thereby permitting insertion of the to-be-held portion 141 into the long hole 140. In addition, when the width in the longitudinal direction of each long hole 140 and the width in the same direction of each to-be-held portion 141 are compared with each other, the width of the to-be-held portion 141 is narrower. As a result, the to-be-held portion 141 is movable through the long hole 140. The moving direction in this case (indicated by arrow in FIG. 8(A)) is the adjusting direction. Therefore, the thermal print head 115 is movable in the adjusting direction. As shown in FIG. 8(B), after the inclined portions 143 formed at the front ends of the to-be-held portions 141 are inserted through the long holes 140, the outsides of the to-be-held portions 141 come into contact with edge portions of the long holes 140, whereby the pawl portions 144 are caught on peripheral edges of the long holes 140 to prevent dislodgment of the to-be-held portions 141 which have reverted to their initial shape. Further, the movement of the to-be-held portions 141 in the right-and-left direction in FIG. 8(B) is restricted. Therefore, the movement of the thermal print head 115 in the longitudinal direction of the heating elements row 115*b* is restricted.

In this construction, as described earlier, a paper guide path GP for guiding the paper 107 is formed between the lower base unit 109 and the upper base unit 114 so as to be positioned in the space extending from the receptacle space of the paper 107 up to the issuance port 105. An outer periphery surface of the platen 116 is positioned in the paper guide path GP and the heating elements row 115*b* in the thermal print head 115 is in abutment against the platen 116 via the paper guide path GP. The thermal print head 115 is urged toward the platen 116 into abutment against the platen by the coiled spring CS which is interposed between the holder 139 and the thermal print head 115. As the platen 116 is rotated, the paper 107 is drawn out and thermosensitive labels provided on the paper 107 are printed by the thermal print head 115. The platen 116 is driven by transmitting power from a power source (not shown) to a driving gear 146 which is mounted on the platen shaft 120 in a dislodgment-prevented manner with a pin 145.

Figure 9A:
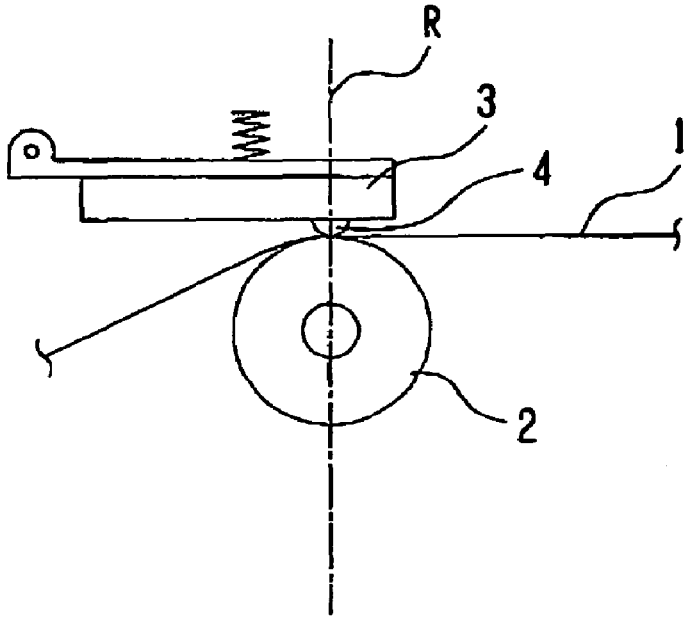
FIG. 9(A) is a schematic diagram showing a positional relation between a platen and a row of heating elements in the thermal print head in case of using thin paper.
Figure 9B:
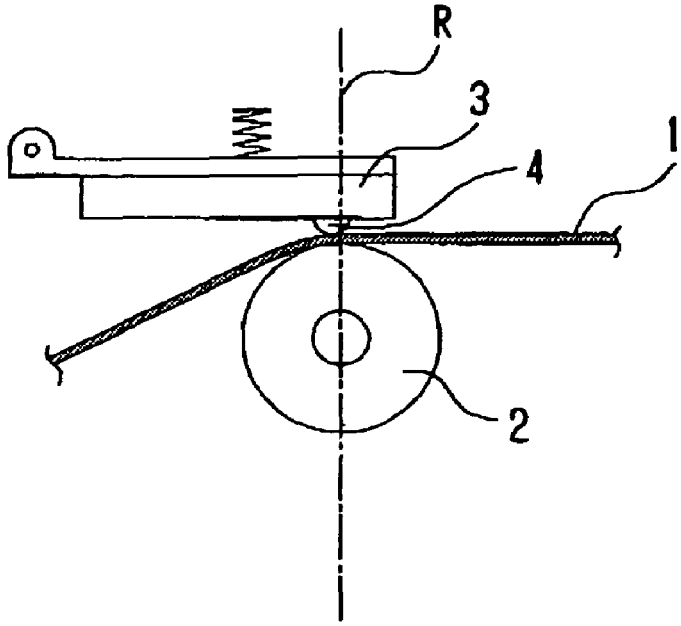
FIG. 9(B) is a schematic diagram showing the positional relation in case of using thick paper.

In printing, it is preferable that the heating elements row 115*b* in the thermal print head 115 be positioned on a radial line of the platen 16 (see FIGS. 9(A) and 9(B)). For example, this position is such a position as shown in FIG. 9(A) which illustrates the use of thin paper 107. In the thermal label printer of this embodiment, in case of using thin paper 107, each movable piece 134 is positioned in the state of FIG. 6(A) or 6(B) with respect to the positioning groove 132 formed in the holder body 123 of the shaft holder 122. More particularly, in the case where the shaft holder 122 illustrated in FIG. 6 is the right-hand shaft holder 122 when seen from the front side of the thermal label printer, the movable piece 134 is located at its position shown in FIG. 6(A). Conversely, in the case where the shaft holder 122 illustrated in FIG. 6 is the left-hand shaft holder 122 when seen from the front side of the thermal label printer, the movable piece 134 is located at its position shown in FIG. 6(B). In the thermal label printer of this embodiment, its constituent portions are constructed so that in such a state the heating elements row 115*b* in the thermal print head 115 are positioned on the radial line of the platen 116. Therefore, when thick paper 107 is used, the position of the heating elements row 115*b* in the thermal print head 115 is deviated from the radial line of the platen 116, as shown in FIG. 9(B). The deviating direction in this case is opposite to the conveying direction of the paper 107. In this case, therefore, the thermal print head 115 is displaced by the displacing mechanism 133. To this end, the movable piece 134 is positioned into the state of FIG. 6(B) or 6(A) by grasping the second grip 137 and rotating the base portion 135. More specifically, in the case where the shaft holder 122 is the right-hand one when seen from the front side of the thermal label printer, the movable piece 134 is located at its position shown in FIG. 6(B). Conversely, in the case where the shaft holder 122 is the left-hand one when seen from the front side of the thermal label printer, the movable piece 134 is located at its position shown in FIG. 6 (A). As a result, the positioning pin 115*a* fitted in the positioning groove 132 is pushed by the movable piece 134 and is displaced in the adjusting direction. As described previously, since the thermal print head 115 is held displaceably in the adjusting direction by the head holding mechanism 138, thermal print head 115 is also displaced in the adjusting direction with the displacement of the positioning pin 115*a* in the same adjusting direction. The adjusting direction in this case is a direction coincident with the conveying direction of paper 107. Consequently, it becomes possible to position the heating elements row 115*b* in the thermal print head 115 onto the radial line of the platen 116.

Thus, since the projecting position of the movable piece 134 relative to the positioning groove 132 is adjusted in accordance with the thickness of paper 107, it becomes possible to position the heating elements row 115*b* in the thermal print heat 115 onto the radial line of the platen 116 and a high quality print can be ensured. In this case, the adjustment of the position of the movable piece 134 relative to the positioning groove 132 can be done by such an extremely simple operation as merely grasping the second grip 137 and turning the base portion 135, and thus the workability concerned is high. Besides, since the base portion 135, movable piece 134 and second grip 137, which constitute the displacement mechanism 133, are disposed within a gap created inevitably between the inner and outer pieces 123*a* , 123*b* of the holder body 123, the displacing mechanism 133 can be prevented from placing limitations on the layout of the entire printer.

Additionally, according to this embodiment, the mounting and dismounting of the platen unit 112 with respect to the lower base unit 109 and the mounting and dismounting of the thermal print head 115 with respect to the upper base unit 114 are extremely simple. That is, in the platen unit 112, the outer pieces 123*b* of the holder bodies 123 are merely elastically deformed and press-fitted in the holders 118 installed on the lower base unit 109 side, so all that is required is merely grasping the first grips 131 and pushing the shaft holders 122 into the holder receptacles 118, whereby the platen unit 112 can be mounted with respect to the lower base unit 109. Conversely, by merely displacing the outer pieces 123*b* of the holder bodies 123 toward the inner pieces 123*a* while grasping the first grips 131 and removing the shaft holders 122 in this state from the holder receptacles 118, the platen unit 112 can be removed from the lower base unit 109. Further, the thermal print head 115 is mounted to the upper base unit 114 by merely inserting its to-be-held portions 141 into the long holes 140. Conversely, the thermal print head 115 can be removed from the upper base unit 114 by merely pulling out the thermal print head 115 while the spacing between the pair of to-be-held portions 141 is narrowed.

Obviously, numerous modifications and variations of the present invention are possible in light of the above teachings. It is therefore to be understood that within the scope of the appended claims, the invention may be practiced otherwise than as specifically described herein.

What is claimed is:

1. A thermal printer, comprising:

a rotatable platen;

a thermal print head including a plurality of heating elements arranged rectilinearly in a row at a printing position where the heating elements are abutted against the platen;

a head holding mechanism for holding the thermal print head to be displaceable in an adjusting direction which is orthogonal to a rectilinear direction between the row of heating elements and a rotational center of the platen;

positioning pins projecting from both sides of the thermal print head;

positioning grooves in which the positioning pins are adapted to be fitted so as to be displaceable in the adjusting direction; and a displacing mechanism including a movable piece, which is movable across an associated one of the positioning grooves such that the movable piece is movable to selectively project from one of opposite sides of the associated positioning groove;

wherein the displacing mechanism positions the positioning pin in the corresponding positioning groove in one of two different positions in the adjusting direction in accordance with the one of the sides of the associated positioning groove from which the movable piece projects, so as to position the thermal print head in one of two different printing positions in the adjusting direction.

2. A thermal printer according to claim 1, wherein the head holding mechanism comprises:

a holder for holding the thermal print head from above;

a long hole formed in the holder;

an anti-dislodgment mechanism which includes a to-be-held portion extending upward from the thermal print head to be inserted into the long hole with play in only an extending direction thereof and in the adjusting direction, and which holds the to-be-held portion inserted into the long hole detachably while preventing dislodgment of the to-be-held portion; and an elastic member interposed between the to-be-held portion and the thermal print head.

3. A thermal printer according to claim 2, wherein the anti-dislodgment mechanism imparts an elastic force to the to-be-held portion in a transverse direction of the long hole and comprises:

an inclined portion, which is provided at a front end of the to-be-held portion, and which is adapted to come into abutment against an edge portion of the long hole so as to cause the to-be-held portion to be deflected when the to-be-held portion is inserted into the long hole; and a pawl portion, which is formed contiguously to the inclined portion, and which is adapted to be caught on a peripheral edge of the long hole to prevent dislodgment of the to-be-held portion when the deflected to-be-held portion reverts to an initial shape of the to-be-held portion upon passage of the inclined portion through the long hole.

4. A thermal printer according to claim 3, further comprising:

a lower unit including the platen, the positioning groove and the displacing mechanism; and an upper unit which includes the thermal print head and the head holding mechanism, and which is pivotable about a fulcrum with respect to the lower unit so that the row of heating elements in the thermal print head is movable away from the platen and into contact with the platen;

wherein a paper guide path is provided between the lower unit and the upper unit.

5. A thermal printer according to claim 2, further comprising:

a lower unit including the platen, the positioning groove and the displacing mechanism; and an upper unit which includes the thermal print head and the head holding mechanism, and which is pivotable about a fulcrum with respect to the lower unit so that the row of heating elements in the thermal print head is movable away from the platen and into contact with the platen;

wherein a paper guide path is provided between the lower unit and the upper unit.

6. A thermal printer according to claim 1, further comprising shaft holders for rotatably holding a platen shaft of the platen;

wherein the positioning grooves are formed in the shaft holders, and wherein the movable piece is rotatably attached to an associated one of the shaft holders and positioned coaxially with the platen shaft, extends up to the associated positioning groove, and is rotatable to project selectively from the opposite sides of the associated positioning groove.

7. A thermal printer according to claim 6, further comprising:

a lower unit including the platen, the positioning groove and the displacing mechanism; and an upper unit which includes the thermal print head and the head holding mechanism, and which is pivotable about a fulcrum with respect to the lower unit so that the row of heating elements in the thermal print head is movable away from the platen and into contact with the platen;

wherein a paper guide path is provided between the lower unit and the upper unit.

8. A thermal printer according to claim 7, wherein the shaft holders exert an elastic force in an axial direction of the platen shaft, and the lower unit includes holder receptacles which permit insertion therein of the shaft holders, respectively, and which position and hold the inserted shaft holders in a deflected state.

9. A thermal printer according to claim 1, further comprising:

a lower unit including the platen, the positioning groove and the displacing mechanism; and an upper unit which includes the thermal print head and the head holding mechanism, and which is pivotable about a fulcrum with respect to the lower unit so that the row of heating elements in the thermal print head is movable away from the platen and into contact with the platen;

wherein a paper guide path is provided between the lower unit and the upper unit.

* * * * *